US009644859B2

(12) United States Patent
Migliore et al.

(10) Patent No.: US 9,644,859 B2
(45) Date of Patent: May 9, 2017

(54) DIRECTIONAL AIR JET SYSTEM FOR AIR REGISTER

(71) Applicants: Michael Migliore, Duluth, GA (US); Maria Migliore, Duluth, GA (US)

(72) Inventors: Michael Migliore, Duluth, GA (US); Maria Migliore, Duluth, GA (US)

( * ) Notice: Subject to any disclaimer, the term of this patent is extended or adjusted under 35 U.S.C. 154(b) by 385 days.

(21) Appl. No.: 14/514,486

(22) Filed: Oct. 15, 2014

(65) Prior Publication Data

US 2015/0111486 A1 Apr. 23, 2015

Related U.S. Application Data

(60) Provisional application No. 61/893,515, filed on Oct. 21, 2013.

(51) Int. Cl.

| | |
|---|---|
| ***F24F 7/00*** | (2006.01) |
| ***F24F 13/06*** | (2006.01) |
| ***F24F 13/08*** | (2006.01) |
| ***F24F 13/065*** | (2006.01) |

(52) U.S. Cl.
CPC ..... *F24F 13/065* (2013.01)

(58) Field of Classification Search
CPC ..... F24F 13/06; F24F 13/082; F24F 13/20; F24F 13/065
See application file for complete search history.

(56) References Cited

U.S. PATENT DOCUMENTS

| | | | | |
|---|---|---|---|---|
| 2,974,580 A * | 3/1961 | Aleksa | F24F 13/065 | 239/457 |
| 3,319,560 A | 5/1967 | Schaaf | | |
| 3,366,363 A * | 1/1968 | Hogan | F24F 13/065 | 251/4 |
| 3,884,134 A | 5/1975 | Jordan | | |
| 4,080,882 A * | 3/1978 | Bruns | F24F 13/062 | 454/299 |
| 4,142,456 A * | 3/1979 | Locker | F24F 13/06 | 239/502 |
| 4,576,331 A * | 3/1986 | Harwell | F24F 7/065 | 236/49.1 |
| 4,716,818 A * | 1/1988 | Brown | F24F 13/10 | 251/252 |
| 4,794,851 A * | 1/1989 | Kurrle | F24F 13/065 | 454/286 |
| 4,848,669 A * | 7/1989 | George | B64D 13/00 | 239/539 |

(Continued)

*Primary Examiner* — Steven B McAllister
*Assistant Examiner* — Jonathan Cotov
(74) *Attorney, Agent, or Firm* — Bryan W. Bockhop; Bockhop Intellectual Property Law, LLC

(57) ABSTRACT

A directional air jet system includes a body frame. The body frame defines a cavity therein. A plurality of pedestals is affixed to the body frame and each has a pedestal surface. A plurality of magnets is each affixed to a different one of the pedestal surfaces and are couple the body frame to the air vent. A turret extends outwardly from the hole defined by the lateral surface and is configured to rotate about a first axis. A ball nozzle is pivotally fit into the turret and defines a bottom opening that is in fluid communication with the cavity through the turret. The ball nozzle is configured to rotate about a second axis that is transverse to the first axis so as to be configured to direct air from the air vent as an air jet in a user-selected direction.

17 Claims, 4 Drawing Sheets

(56) References Cited

U.S. PATENT DOCUMENTS 5,501,634 A * 3/1996 Wilder ..... B60H 1/00378 454/109
5,584,761 A * 12/1996 Locker ..... F24F 13/062 454/302
5,807,171 A * 9/1998 Felsen ..... F24F 13/06 454/296
6,135,878 A * 10/2000 Felsen ..... F24F 13/075 454/296
6,554,880 B1 * 4/2003 Northcutt ..... B01D 46/0006 454/292
6,719,623 B1 * 4/2004 Kodaveridan ..... B64D 13/00 454/154
6,797,028 B2 * 9/2004 Duffy ..... B01D 46/001 454/187
7,645,188 B1 * 1/2010 Peerbolt ..... F24F 13/06 454/284
7,651,390 B1 * 1/2010 Profeta ..... F24F 13/06 454/284
8,292,708 B2 * 10/2012 Viggers ..... F24F 13/20 454/275
8,342,923 B2 * 1/2013 Mavroudis ..... F24F 13/082 454/275
8,460,075 B2 * 6/2013 Mavroudis ..... F24F 13/084 454/275
8,778,042 B2 * 7/2014 Albert ..... F24F 13/20 55/373
9,360,230 B2 * 6/2016 Breed ..... F24F 13/20
2002/0069599 A1 * 6/2002 Dhallan ..... F24F 13/082 52/302.1
2005/0262719 A1 * 12/2005 Calbreath ..... F26B 21/004 34/239
2008/0160904 A1 * 7/2008 Yi ..... F24F 13/12 454/309
2008/0227382 A1 * 9/2008 Profeta ..... F24F 13/06 454/358
2009/0302544 A1 * 12/2009 Pugh, Jr. ..... F16J 15/122 277/312
2010/0233953 A1 * 9/2010 Mavroudis ..... F24F 13/084 454/276
2012/0052787 A1 * 3/2012 Zecha ..... F24F 13/065 454/289
2013/0059520 A1 3/2013 Wolf et al.
2013/0331023 A1 * 12/2013 Yalmeh ..... F24F 13/1426 454/275

* cited by examiner

DIRECTIONAL AIR JET SYSTEM FOR AIR REGISTER

CROSS-REFERENCE TO RELATED APPLICATION(S)

This application claims the benefit of US Provisional Patent Application Ser. No. 61/893,515, filed Oct. 21, 2013, the entirety of which is hereby incorporated herein by reference.

FIELD OF THE INVENTION

The present invention relates to air ventilation systems and, more specifically, to an attachment to an air register for directing an air jet to a desired location.

DESCRIPTION OF THE RELATED ART

Typical residential air ventilation systems include air ducts that transport air from a heating and cooling system to air registers located in different rooms throughout a house. Some registers are relatively close to the heating and cooling system, whereas other registers can be much farther away from the heating and cooling system. With some systems, there can be a substantial air pressure drop at the more distant registers. This can result in less air being delivered to inhabitants of distant rooms.

Existing systems used to alleviate discomfort in such distant rooms typically involve boosting airflow through a duct with a fan disposed in a register. Such systems usually require an electrical connection, which is frequently manifested as an electrical cord that is plugged into a wall outlet. Such systems have the disadvantages of being unsightly and being limited in range by the length of the electrical cord. Also, these systems often must be installed by removing an existing register and replacing it with a booster system.

Even in rooms that are closer to the heating and cooling unit, some users desire enhanced airflow. For example, people experiencing hot flashes often prefer air flow directed at a specific location.

Therefore, there is a need for a device that directs airflow from a register to a specific location.

SUMMARY OF THE INVENTION

The disadvantages of the prior art are overcome by the present invention which, in one aspect, is a directional air jet system for directing air from a vent register that includes a body frame having a foot surface and a shape configured to cover substantially the vent register. The body frame defines a cavity in fluid communication with the vent register. The cavity opens to a circular hole passing therethrough. A frustoconical member is disposed in the circular hole and is engaged with the body portion. The frustoconical member defines a circular top opening and an elliptical bottom opening. The frustoconical member is configured to rotate with in the circular hole. A ball nozzle is disposed within the elliptical bottom opening and engaged with the frustoconical member. The ball nozzle is configured to rotate relative to the frustoconical member. The ball nozzle defines a nozzle opening that is in fluid communication with the vent register through the circular hole, the circular top opening and the elliptical bottom opening, so that air passing through the nozzle opening forms a jet that flows in a selected direction.

At least one magnet is affixed to the foot surface and is configured to attach the directional air jet system to the vent register.

In another aspect, the invention is a directional air jet system for directing air from an air vent that includes a body frame. The body frame has a peripheral wall and a lateral surface extending upwardly from the peripheral wall. The peripheral wall and the lateral surface define a cavity therein that opens to a hole defined by the lateral surface. The peripheral wall terminates in a foot edge that defines an open base opposite from the lateral surface that is in fluid communication with the cavity and that is configured to overlay the air vent. A plurality of pedestals is affixed to the body frame and is disposed inside the cavity. Each of the plurality of pedestals has a pedestal surface that is spaced apart by a predetermined distance from a plane defined by the foot edge. A plurality of magnets is each affixed to a different one of the pedestal surfaces and has a thickness corresponding to the predetermined thickness. The plurality of magnets is configured to removably couple the body frame to the air vent. The plurality of magnets has a distribution and dimensions so as to be configured to couple the body frame to a variety of different air vent sizes. A turret extends outwardly from the hole defined by the lateral surface and is configured to rotate about a first axis. A ball nozzle is pivotally fit into the turret and defines a bottom opening that is in fluid communication with the cavity through the turret. The ball nozzle is configured to rotate about a second axis that is transverse to the first axis so as to be configured to direct air from the air vent as an air jet in a user-selected direction.

In another aspect, the invention is a peripheral ledge extending inwardly from the foot edge of the peripheral wall and configured to deflect air inwardly toward the cavity.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1B:
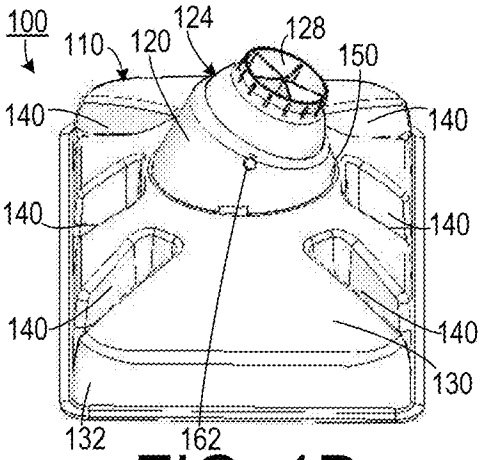
FIG. 1B is a side-view isometric projection of the embodiment shown in FIG. 1A.
Figure 1D:
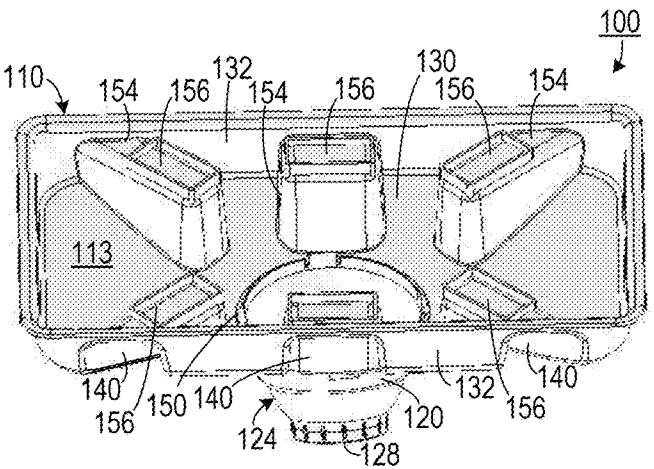
FIG. 1D is an underside-view isometric projection of the embodiment shown in FIG. 1A.
Figure 1A:
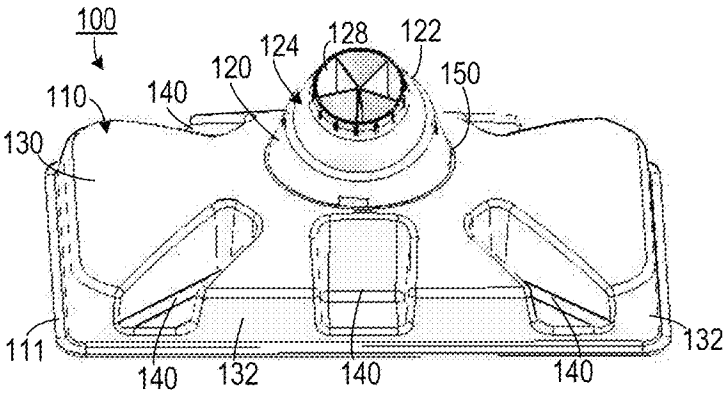
FIG. 1A is a front isometric projection of one embodiment of a directional air jet system.
Figure 1C:
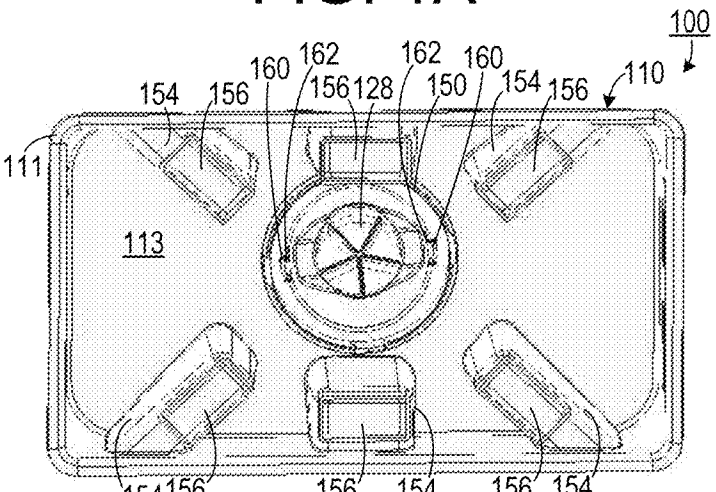
FIG. 1C is an underside plan view of the embodiment shown in FIG. 1A.

A preferred embodiment of the invention is now described in detail. Referring to the drawings, like numbers indicate like parts throughout the views. Unless otherwise specifically indicated in the disclosure that follows, the drawings are not necessarily drawn to scale. As used in the description herein and throughout the claims, the following terms take the meanings explicitly associated herein, unless the context clearly dictates otherwise: the meaning of "a," "an," and "the" includes plural reference, the meaning of "in" includes "in" and "on."

As shown in FIGS. 1A-1D and 2-5, one embodiment is a system 100 for directing a jet 20 of air from a vent register 14 associated with duct 12 from a heating and cooling system. Typically, the vent register 14 is attached to a wall, a ceiling 10 or a floor of a room and the system 100 overlays the vent register 14.

The directional air jet system 100 includes a body frame 110 having a foot edge 111 that is shaped so that it covers the vent register 14. Flat magnets 160 are affixed to the body frame 110 and are used to affix the system 100 against the vent register 14. (Other methods of affixing the system 100 to the vent register 14 may also be used, including: two-sided tape, fasteners, etc.) The body frame 110 includes a peripheral wall 132 and a lateral surface 130 extending from the peripheral wall 132. The peripheral wall 132 and the lateral surface 130 define the cavity 113. The foot edge 111 defines an open base opposite from the lateral surface 130 that is in fluid communication with the cavity 113 and that is configured to overlay the air vent 14.

Figure 2:
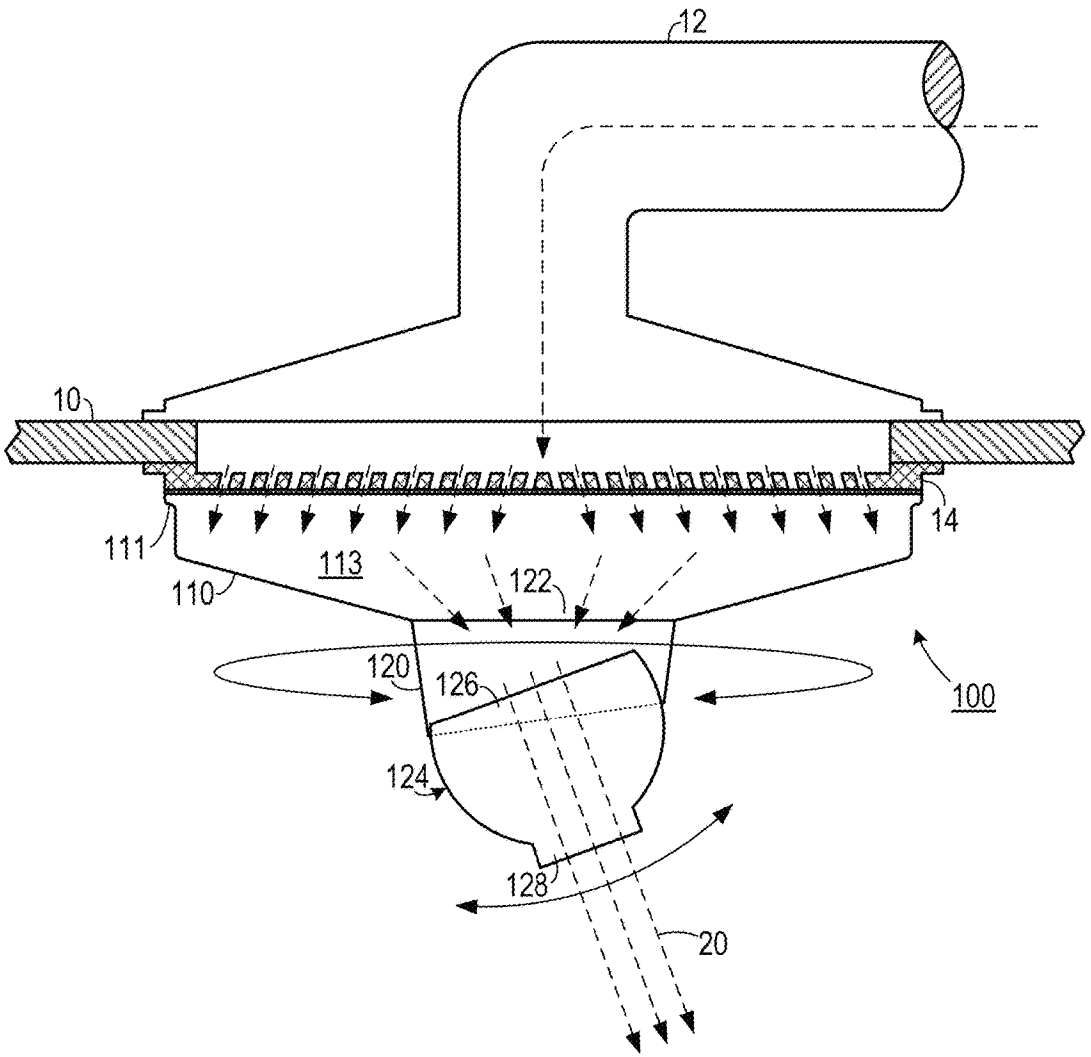
FIG. 2 is a schematic representation of one embodiment applied to a vent register.
Figure 3:
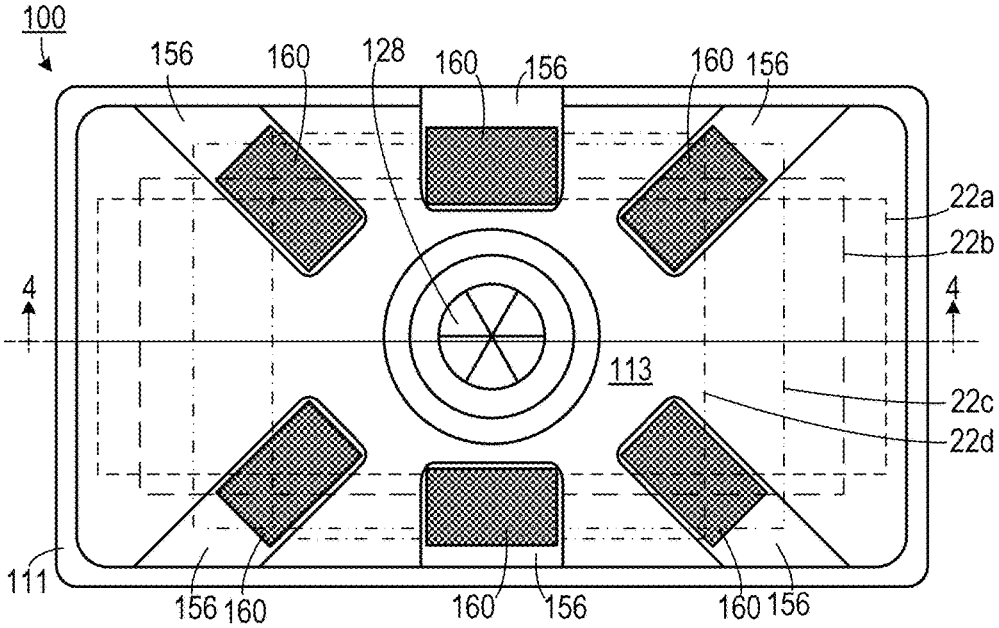
FIG. 3 is an underside plan view of the directional air jet system shown in FIG. 1A showing disposition of magnets.

The body frame 110 defines a cavity 113 in fluid communication with the vent register 14 (air flow from the duct 12 through the register 14 and the system is shown with broken lines in FIG. 2). The cavity 113 opens to a circular hole 150 passing therethrough. A frustoconical turret member 120 is disposed in the circular hole 150, is engaged with the body frame 110 and is configured to rotate within the hole 150 (by 360° in one embodiment). The frustoconical member 120 defines a circular top opening 121 and an elliptical bottom opening 122, which is on a plane that is transverse to the plane of the circular top opening. A ball nozzle 124 is disposed in and engaged with the elliptical bottom opening 122 so as to be able to rotate transversely with respect to the frustoconical member 120. In one embodiment, the ball nozzle 124 includes oppositely disposed pins 162 that fit into pin joists 160 defined by the frustoconical member 120 at pivot points so that the ball nozzle 124 can rotate by pivoting. The boll nozzle 124 pivots along an axis that is transverse to the rotational axis of the turret 120, thereby allowing the system 100 to direct air in almost any user selected direction from the vent 14. The ball nozzle defines a nozzle opening 128 that is in fluid communication with the vent register 14 and a bottom opening 128 that forms air passing through the nozzle opening 128 into a jet 20 that flows in a direction desired by the user.

Figure 4:
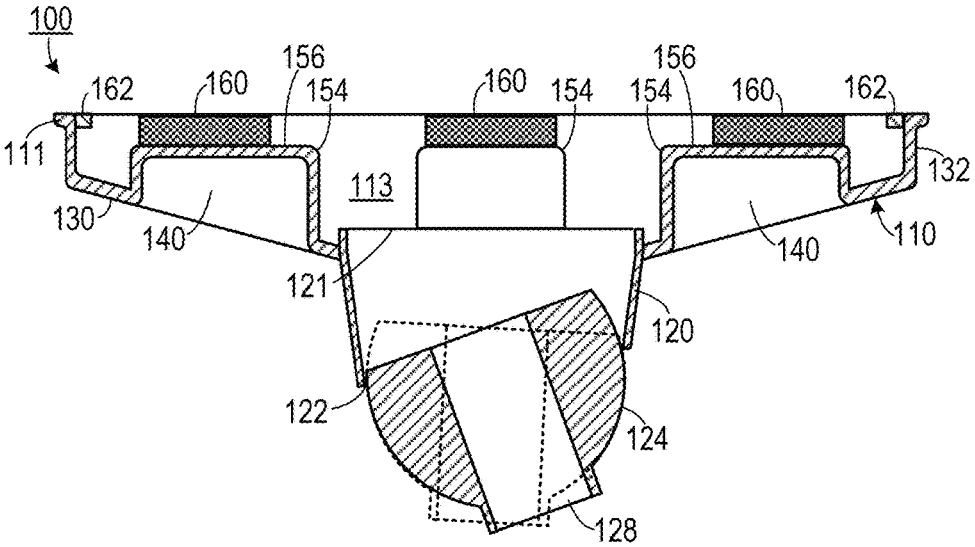
FIG. 4 is a cross section of one embodiment of the directional air jet system shown in FIG. 3, taken along line 4-4.

In one embodiment, the body frame 110 defines a plurality of pedestals 154, affixed to the body frame and disposed inside the cavity 113. Each of the pedestals 154 has a pedestal surface 156 that is spaced apart from a plane defined by the foot edge 111 by a distance corresponding to the width of the magnets 160, so that the magnets 160 are able to engage the vent 14 when the system 100 is placed against the vent 14. As shown specifically in FIG. 3, the magnets 160 (which may be elongated rectangular in shape) are distributed so that they can couple the body frame 110 to overlay a variety of different air vent sizes 22*a*-22*d*. As shown in FIG. 4, the pedestals 154 can be formed as indentations 140 in the body frame 110 that provide a gripping surface that allows the user to remove the system 100 from the vent at will.

In one embodiment, the body frame 110, the frustoconical member 120 and the ball nozzle 124 are injection molded and made of acrylonitrile butadiene styrene (ABS). As will be readily appreciated by those of skill in the art, these elements may also be made from many other materials, including other plastics and metals and made through other processes.

In one embodiment, a peripheral ledge 162 can extend inwardly from the foot edge 111 of the peripheral wall 132. The ledge 162 deflect air inwardly toward the cavity 113. In one embodiment, the ledge 162 can be a weather stripping gasket disposed peripherally about the inside of the foot edge 111. In another embodiment, it can be a rubber band that is stretched about the foot edge 111 so as to have an edge extending into the cavity 113.

Figure 5:
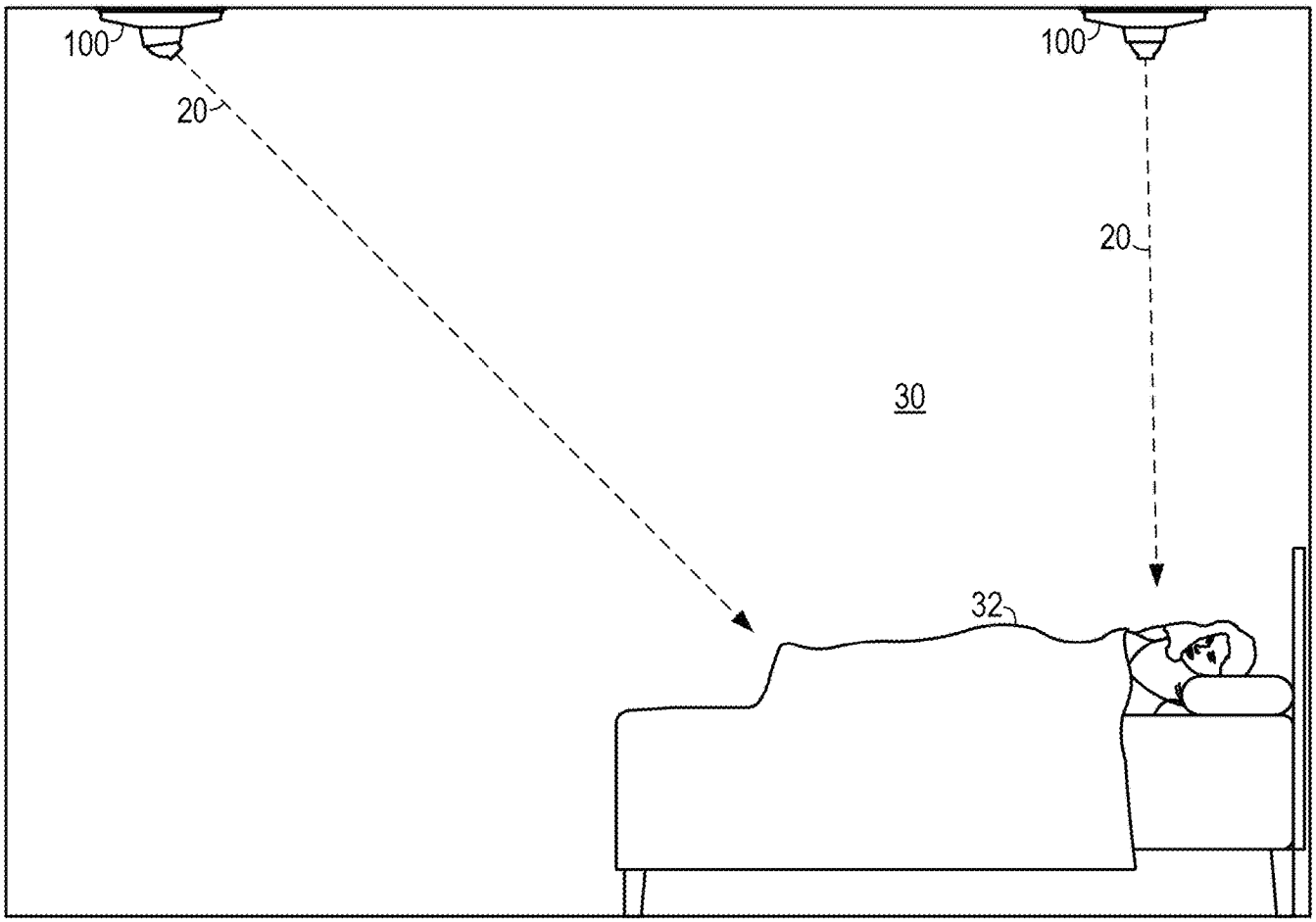
FIG. 5 is a schematic representation a directional air jet system in use.

A shown in FIG. 5, directional air jet systems 100 can be placed on several different vent registers in a room 30. The user 32 can then adjust each system to direct air to a specific desired location.

One embodiment is an accessory to any existing steel floor, wall, or ceiling register vent. With its one-size-fits all design, it magnetically mounts to the face of a vent. Self-powered, without the use of batteries or electric, it strictly utilizes the exiting thermodynamics of the ambient air pressure at any such vent, compressing the existing outbound air into a chamber, and forcing it out as a jet stream with enough force to move warm or cool air across a room. The multi-directional nozzle permits the user the ability to direct and control the air to where it best fits their needs.

The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. A directional air jet system for directing air from an air vent, comprising:

(a) a body frame having a peripheral wall and a lateral surface extending from the peripheral wall, the peripheral wall and the lateral surface defining a cavity therein that opens to a hole defined by the lateral surface, the peripheral wall terminating in a foot edge that defines an open base opposite from the lateral surface that is in fluid communication with the cavity and that is configured to overlay the air vent;

(b) a plurality of pedestals affixed to the body frame and disposed inside the cavity, each of the plurality of pedestals having a pedestal surface that is spaced apart by a predetermined distance from a plane defined by the foot edge;

(c) a plurality of magnets each affixed to a different one of the pedestal surfaces and having a thickness corresponding to the predetermined distance, the plurality of magnets configured to removably couple the body frame to the air vent, the plurality of magnets having a distribution and dimensions so as to be configured to couple the body frame to a variety of different air vent sizes;

(d) a turret extending outwardly from the hole defined by the lateral surface and configured to rotate about a first axis;

(e) a ball nozzle pivotally fit into the turret and defining a bottom opening that is in fluid communication with the cavity through the turret, the ball nozzle configured to rotate about a second axis that is transverse to the first axis so as to be configured to direct air from the air vent as an air jet in a user-selected direction; and (f) a plurality of indentations in an outside surface of the body frame that are configured to provide a gripping surface, wherein the indentations in the outside surface of the body frame form the pedestals inside the cavity.

2. The directional air jet system of claim 1, wherein the turret has a frustoconical shape with an open bottom and an open top, the open top having a greater diameter than the open bottom, the open top having a shape that is complementary to the hole defined by the lateral surface and the open bottom having a shape that corresponds to the ball nozzle.

3. The directional air jet system of claim 2, wherein the turret has a top edge that lies along a first plane and a bottom edge that lies along a second plane, wherein the first plane is parallel to the air vent and wherein the second plane is transverse to the first plane.

4. The directional air jet system of claim 1, wherein the turret is configured to rotate 360° about the first axis.

5. The directional air jet system of claim 1, wherein the magnets comprise elongated rectangular magnets.

6. The directional air jet system of claim 1, further comprising a peripheral ledge extending inwardly from the foot edge of the peripheral wall and configured to deflect air inwardly toward the cavity.

7. The directional air jet system of claim 1, wherein the turret defines two oppositely disposed pin bosses and wherein the ball nozzle is coupled to the turret by two oppositely disposed pins disposed along the second axis that are fit into the pin bosses.

8. The directional air jet system of claim 1, wherein the body frame, the plurality of pedestals, the turret and the ball nozzle each comprise an injection molded plastic.

9. The directional air jet system of claim 8, wherein the plastic comprises acrylonitrile butadiene styrene.

10. A directional air jet device for directing air from an air vent, comprising:

(a) a body frame having a peripheral wall and a lateral surface extending upwardly from the peripheral wall, the peripheral wall and the lateral surface defining a cavity therein that opens to a hole defined by the lateral surface, the peripheral wall terminating in a foot edge that defines an open base opposite from the lateral surface that is in fluid communication with the cavity and that is configured to overlay the air vent;

(b) a plurality of indentations formed in the body frame, each indentation having an inside surface disposed inside the cavity, the inside surface of each indentation including a pedestal surface that is spaced apart by a predetermined distance from a plane defined by the foot edge;

(c) a plurality of elongated rectangular magnets each affixed to a different pedestal surface and having a thickness corresponding to the predetermined distance, the plurality of magnets configured to removably couple the body frame to the air vent, the plurality of magnets having a distribution and dimensions so as to be configured to couple the body frame to a variety of different air vent sizes;

(d) a frustoconicly-shaped turret extending outwardly from the hole defined by the lateral surface and configured to rotate 360° about a first axis, the turret having a top edge that lies along a first plane and a bottom edge that lies along a second plane, the first plane being parallel to the air vent and the second plane being transverse to the first plane; and (e) a ball nozzle pivotally fit into the turret and defining a bottom opening that is in fluid communication with the cavity through the turret, the ball nozzle configured to rotate about a second axis that is transverse to the first axis so as to be configured to direct air from the air vent as an air jet in a user-selected direction.

11. The directional air jet device of claim 10, wherein each of the plurality of indentations has an outsider surface that is configured to provide a gripping surface.

12. The directional air jet device of claim 10, wherein the turret has an open bottom and an open top, the open top having a greater diameter than the open bottom, the open top having a shape that is complementary to the hole defined by the lateral surface and the open bottom having a shape that corresponds to the ball nozzle.

13. The directional air jet device of claim 10, further comprising a peripheral ledge extending inwardly from the foot edge of the peripheral wall and configured to deflect air inwardly toward the cavity.

14. The directional air jet device of claim 10, wherein the turret defines two oppositely disposed pin bosses and wherein the ball nozzle is coupled to the turret by two oppositely disposed pins disposed along the second axis that are fit into the pin bosses.

15. The directional air jet device of claim 10, wherein the body frame, the plurality of pedestals, the turret and the ball nozzle each comprise an injection molded plastic.

16. The directional air jet device of claim 15, wherein the plastic comprises acrylonitrile butadiene styrene.

17. A directional air jet vent cover, comprising:

(a) an acrylonitrile butadiene styrene body frame having a peripheral wall and a lateral surface extending upwardly from the peripheral wall, the peripheral wall and the lateral surface defining a cavity therein that opens to a hole defined by the lateral surface, the peripheral wall terminating in a foot edge that defines an open base opposite from the lateral surface that is in fluid communication with the cavity and that is configured to overlay the air vent;

(b) a plurality of indentations formed in the body frame, each indentation having an inside surface disposed inside the cavity, the inside surface of each indentation including a pedestal surface that is spaced apart by a predetermined distance from a plane defined by the foot edge, each of the plurality of indentations has an outsider surface that is configured to provide a gripping surface;

(c) a plurality of elongated rectangular magnets each affixed to a different pedestal surface and having a thickness corresponding to the predetermined distance, the plurality of magnets configured to removably couple the body frame to the air vent, the plurality of magnets having a distribution and dimensions so as to be configured to couple the body frame to a variety of different air vent sizes;

(d) an acrylonitrile butadiene styrene frustoconicly-shaped turret extending outwardly from the hole defined by the lateral surface and configured to rotate 360° about a first axis, the turret having a top edge that lies along a first plane and a bottom edge that lies along a second plane, the first plane being parallel to the air vent and the second plane being transverse to the first plane, the turret defining two oppositely disposed pin bosses;

(e) an acrylonitrile butadiene styrene ball nozzle pivotally fit into the turret and defining a bottom opening that is in fluid communication with the cavity through the turret, the ball nozzle configured to rotate about a second axis that is transverse to the first axis so as to be configured to direct air from the air vent as an air jet in a user-selected direction, two oppositely disposed pins extending from opposite sides of the ball nozzle along the second axis, the pins fit into the pin bosses; and (f) a peripheral ledge extending inwardly from the foot edge of the peripheral wall and configured to deflect air inwardly toward the cavity.

* * * * *